US008006521B2

(12) United States Patent
Rocchitelli

(10) Patent No.: US 8,006,521 B2
(45) Date of Patent: Aug. 30, 2011

(54) LOCKING DEVICE FOR THE CLOSING LID OF WASHING MACHINES

(75) Inventor: Onofrio Rocchitelli, Pogliano Milanese (IT)

(73) Assignee: Elettrotecnica Rold S.R.L., Nerviano (Milano) (IT)

( * ) Notice: Subject to any disclaimer, the term of this patent is extended or adjusted under 35 U.S.C. 154(b) by 232 days.

(21) Appl. No.: 12/230,589

(22) Filed: Sep. 2, 2008

(65) Prior Publication Data

US 2009/0013733 A1 Jan. 15, 2009

(51) Int. Cl.
*D06F 37/28* (2006.01)

(52) U.S. Cl. ..... 68/12.26; 68/196; 134/57 DL; 134/58 DL

(58) Field of Classification Search ..... 68/3 R, 68/12.26; 134/57 DL, 58 DL
See application file for complete search history.

(56) References Cited

U.S. PATENT DOCUMENTS 2,468,584 A * 4/1949 Wotring ..... 134/57 DL
2,759,485 A * 8/1956 Guth ..... 134/58 DL
3,715,552 A * 2/1973 Umezu et al. ..... 219/724
3,898,412 A * 8/1975 Robinson et al. ..... 219/724
5,520,424 A * 5/1996 Hapke et al. ..... 292/198

FOREIGN PATENT DOCUMENTS

| | | |
|---|---|---|
| DE | 201116028 | * 11/2001 |
| JP | 04-361797 | * 12/1992 |
| JP | 06-246093 | * 9/1994 |
| JP | 2000-051567 | * 2/2000 |
| JP | 2001-204984 | * 7/2001 |

OTHER PUBLICATIONS

European Patent Office 0 817 535 Jan. 1998.*

* cited by examiner

*Primary Examiner* — Frankie L Stinson
(74) *Attorney, Agent, or Firm* — Jacobson Holman PLLC

(57) ABSTRACT

A locking device for the closing lid of washing machines having a containing body that houses a cursor equipped with an opening capable of receiving the hook mounted on the lid. A delaying device is capable of locking the cursor in a position retaining the latch. In order to ensure that the user operates under safe conditions, the device provides a lever that is equipped with a device to lock the cursor, and is connected to the body by a link.

7 Claims, 4 Drawing Sheets

LOCKING DEVICE FOR THE CLOSING LID OF WASHING MACHINES

The present invention concerns a locking device for the closing lid of washing machines and the like.

The invention concerns in particular, while not to be understood in a limiting sense, front-loading cloth washing machines.

The basket of front-loading cloth washing machines is closed by a (tightly) sealing lid hinged to the front panel of the machine and fitted with a closing latch or hook engaged by a locking device which is mounted on the machine front panel.

In order to guarantee the user's operation under safe conditions, the locking device comprises an electromechanical device known as a door-lock, that prevents the opening of the lid after the machine has been started, and delays its opening after completion of the operating cycle, until the inertial rotation of the inside drum has ended.

In the already known devices, under normal operating conditions the activation of the door-locking device is mechanically prevented if the lid is open, and in case the device is serially connected on one phase of the machine feeding system, it also fulfils the function of preventing the machine from starting when the lid is open.

However, these devices have the drawback that a operating cycle of the machine could be started even when the lid is open, for instance by inserting a finger in the space provided for the door hook for simulating the movement of the hook that creates the conditions for activating the door-locking device.

In order to comply with the existing European and U.S. standards in the washing machine sector, in particular Standard EN60335-27 (2003 edition), par. 20 and Standard UL2156 par. 20.8.5, the door-locking device of a washing machine must not allow the activation of the machine when a testing finger of a predetermined size is used in a tampering attempt.

There are already known devices that in compliance with the mentioned Standards provide for a mechanism that has been modified both in respect of the shape of the hook and the shape of the cursor and of the small template provided on the machine front panel to receive the hook.

The implementing of these devices implies however a need of producing and storing a number of components for usage depending on the market the machine is addressed to.

An object of the present invention is to realize a door-locking device for washing machines and the like capable of meeting the tests envisioned by the European and U.S. standards, by mechanically preventing the start-up of the machine with the lid open, when trying to tamper the device with a "finger" of the size provided for by the Standards, with a particularly simple and effective construction.

According to the invention, this object is achieved by a door-locking device for the closing lid according to claim 1. Additional advantageous characteristics are recited in the dependent claims.

The invention will now be described with reference to the attached drawings that illustrate a preferred but non-limiting embodiment of the invention, in which.

Figure 1:
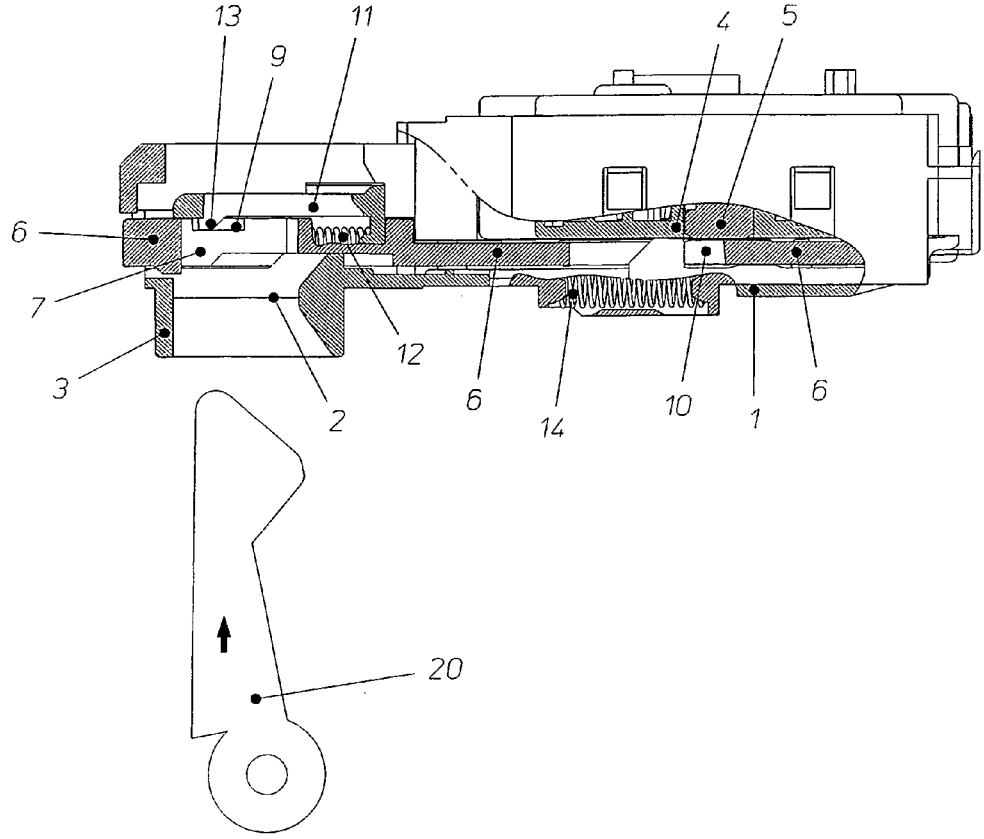
FIG. 1 is a cross-section view of the door-locking device according to the invention, in an open lid position.
Figure 2:
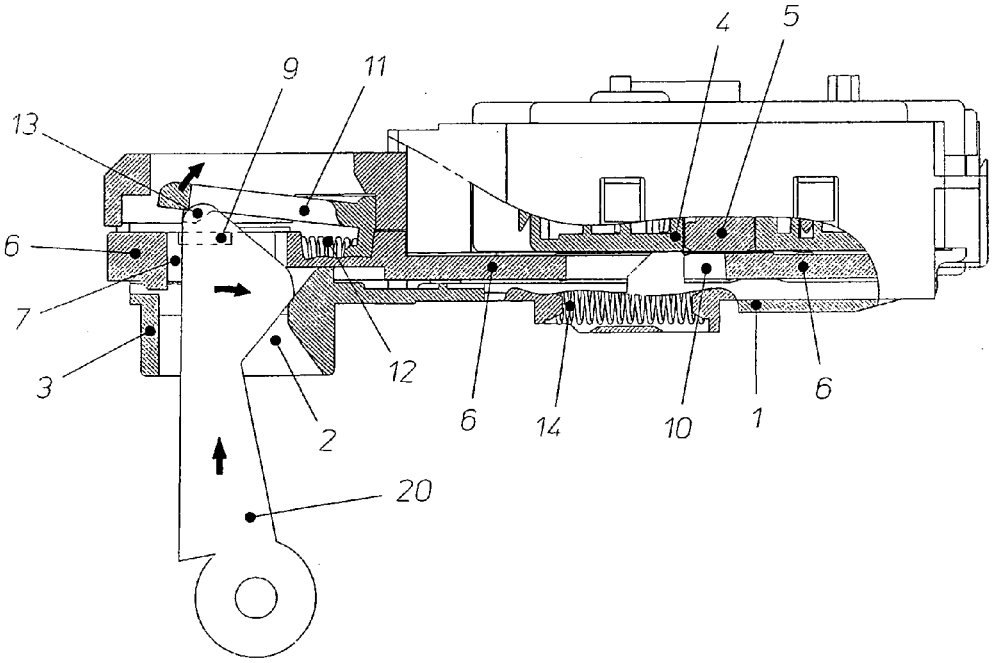
FIG. 2 is a cross-section view of the device in a lid-closing phase.
Figure 7:
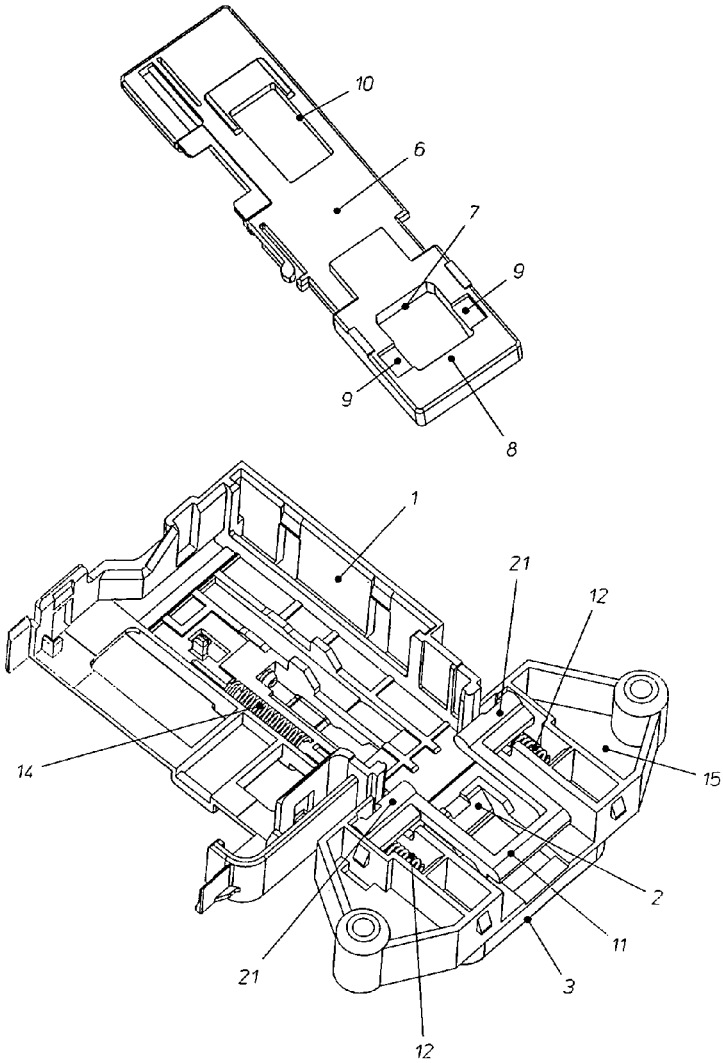
FIG. 7 is an axonometric view of the device in an assembling phase.

With reference to FIGS. 1, 2 and 7, the device according to the invention comprises a containing body 1, preferably made of a thermoplastic material, that comprises a portion 15 fitted with means for fastening to the front lid of the washing machine and a closing lid 16.

The portion 15 is realized with a square opening 2, capable of receiving the lid hook 20 and fitted with a projecting rim 3 to be seated in the front panel of the machine so as to receive and retain the hook.

The body 1 further houses a sliding cursor 6 subjected to the action of elastic means 14 and an electromechanical delaying device 4 of an already known type.

The delaying device 4 comprises a pawl 5 that is operated by a system connected to the machine actuating controls, for instance through a movable contact blade of a micro-switch mounted in series on one phase of the machine powering system.

The cursor 6 presents, at the opening 2 of the support 1, a square opening 7 fitted with a thickened frame 8 with two recesses 9.

Opposite the electromechanical delaying device 4, there is a window or seat 10 provided to receive the locking pawl 5.

With particular reference to FIG. 7, a locking lever 11 with a U-profile is seated inside the body 1, in correspondence of the opening 2 and connected to this latter with a hinge-type link 21.

The link 21 is advantageously realized with helical springs 12 arranged so as to allow, in addition to a rotation and return action of the lever 11 to its resting position, an axial motion of the lever along the sliding axis of the cursor 6.

The lever 11 if equipped with two small projections or prongs that fit into the recesses 9 of the cursor 6.

The device operates as follows.

In an opened lid position, the elements of the device are in the reciprocal positions shown in FIG. 1. In particular, the lever 11 blocks the small projections 13 of the cursor 6 to prevent the cursor translation, while the cursor 6 inhibits actuating the pawl 5 of the door-lock 4, because it is positioned with the axis of the window 10 offset with respect to the pawl sliding axis. The machine start-up is thus inhibited.

Figure 3:
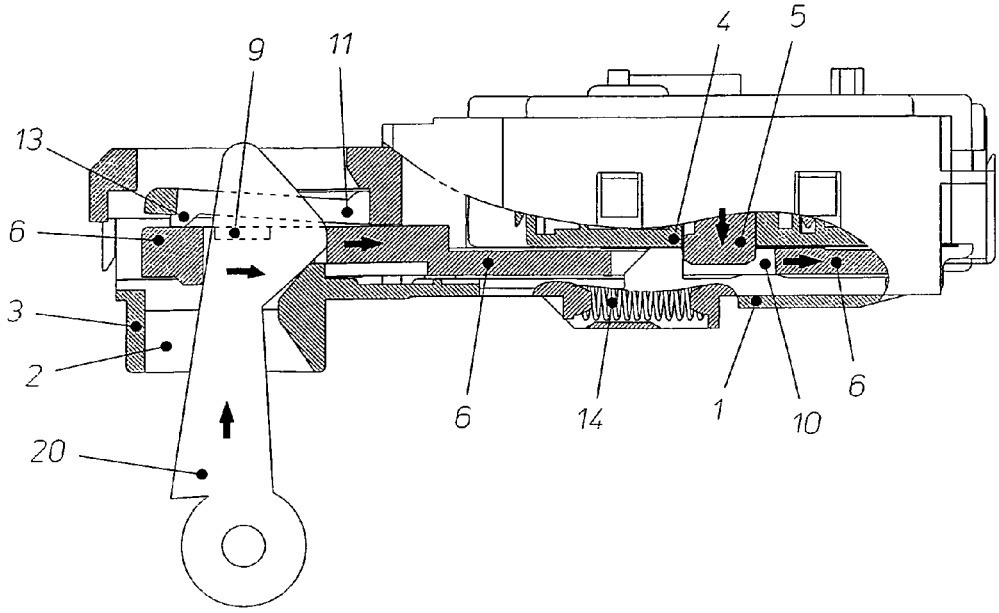
FIG. 3 is a cross-section view of the device in a closed lid position.

With reference to FIGS. 2 and 3, upon closing the lid, the hook 20 enters the opening 2 while at the same time acting on the lever 11 and on the cursor 6, causing the rotation of the lever 11, which releases the projections 13 from the recesses 9 to disengage the cursor 6 and allowing it to be shifted against the action of the elastic means 14.

As soon as the lid closing position is reached, the window 10 of the cursor 6 becomes aligned with the axis of the pawl 5 of the door-locking device 4, and this latter can snap into the holding position of the hook 20, while the lever 11 is pushed forward to rest against the cursor 6.

Figure 4:
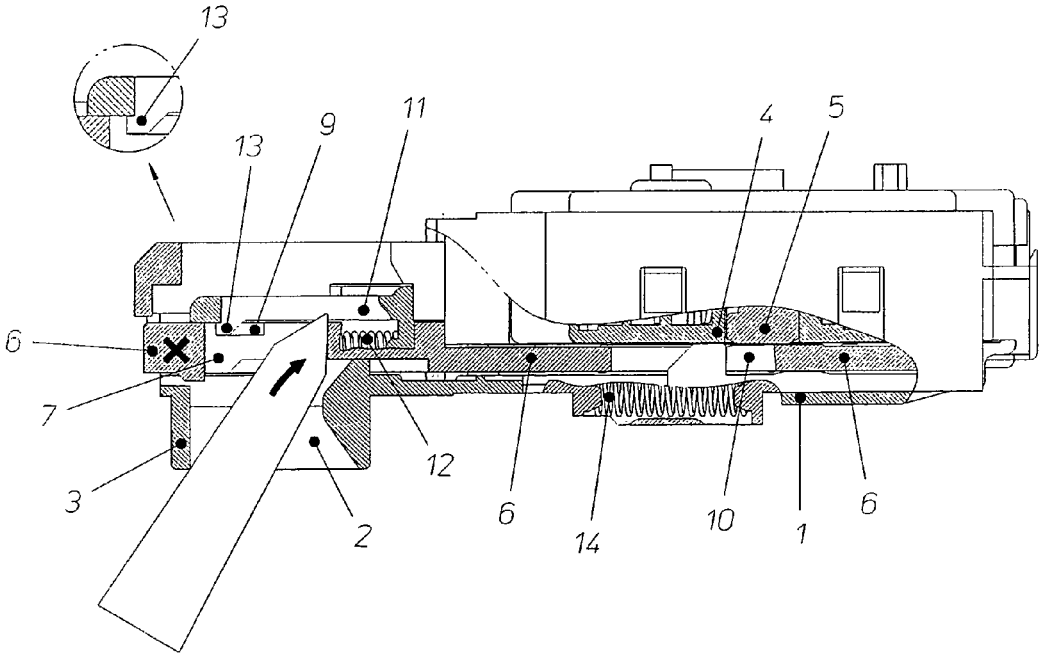
FIG. 4 is a cross-section view of the device with a test finger inserted.

If on the contrary a test finger 11 is inserted into the opening as shown in FIG. 4 in an attempt to actuate the cursor 6, the lever 11 locks the cursor 6 thanks to the engagement of the small projections 13, thus preventing the sliding thereof and the consequent lodging of the seat 10 into alignment with the pawl 5. As a matter of fact the insertion of a finger cannot achieve the simultaneous actuation of the locking lever 11 and of the cursor 6 (an operation properly achieved only by the insertion of the hook), and thus the start-up of the machine is prevented.

Figure 5:
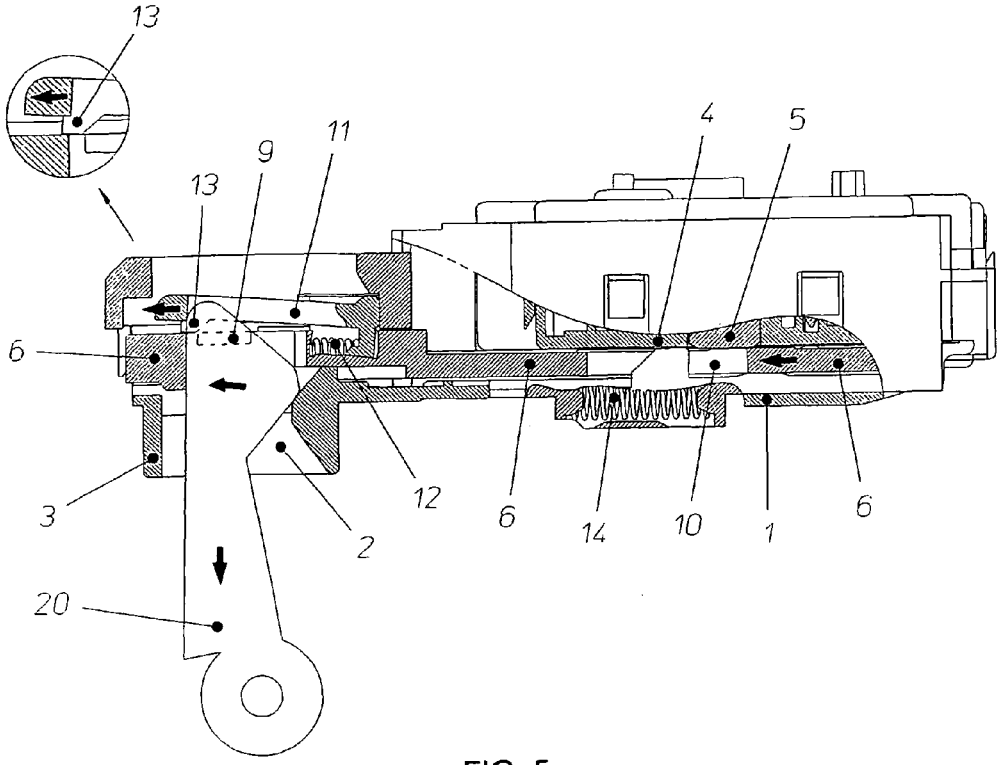
FIGS. 5 and 6 are cross-section views of the device in a lid opening phase.
Figure 6:
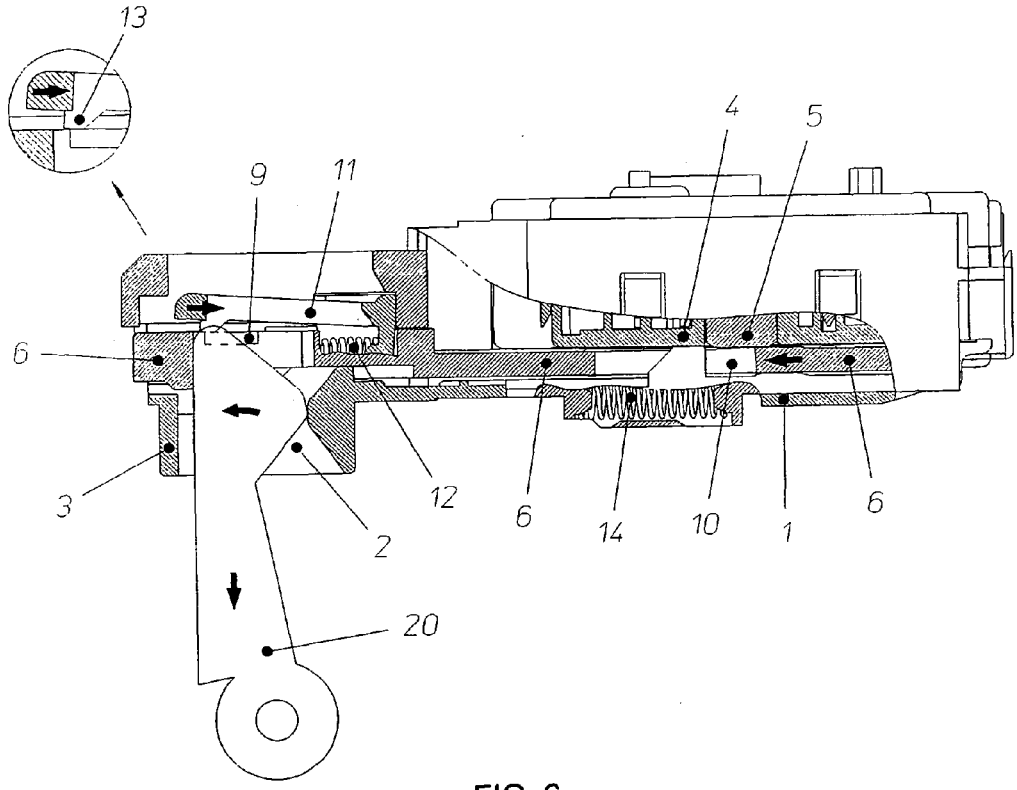

With reference to FIGS. 5 and 6, in a lid opening phase at the end of the operating cycle and in accordance with the known art, the locking pawl 5 slides back and disengages the cursor 6. By rotating the hook 20 to allow it to be extracted from the opening 2, the hook acts on the lever causing its initial translation, which is needed to compensate and dampen the motion of the hook. The subsequent rotation of the hook causes the rotation of the lever 11 and the simultaneous translation of the cursor 6, which returns the elements of the device to their respective positions shown in FIG. 1.

As shown in the disclosed embodiment, advantageously the lever 11 can seat in the portion 15 of the containing body or can be mounted on the closing lid 16 of the same.

Figure 8:
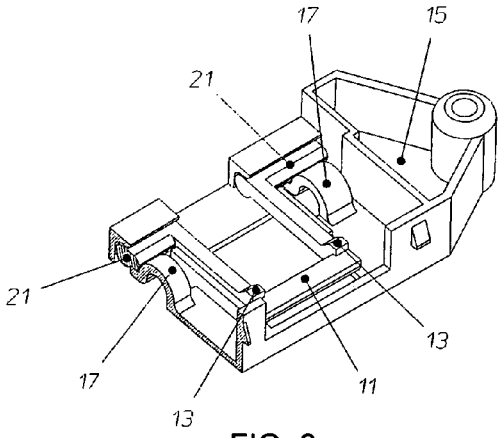
FIGS. 8 and 9 illustrate two possible embodiments of the locking lever shown in FIG. 7.
Figure 9:
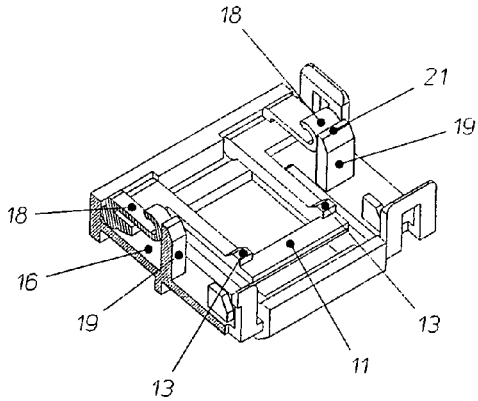

In order to simplify the device's assembling operations, it is also possible to provide elastic means for connecting the lever 11 to the support 1 or the lid 16, which are alternative to the springs 12 but equivalent to them. For exemplifying purposes, the detail shown in FIG. 8 provides elastic flaps 17 arranged on the support 1 that oppose the ends of the lever 11, while FIG. 9 shows elastic flaps 18 arranged on the lever 11 so as to oppose pins 19 provided on the lid 16.

Although the invention has been illustrated with reference to preferred embodiments, the same is generally susceptible of further applications and modifications intended to be included within the scope of the invention, as will be evident to the skilled of the art.

The invention claimed is:

1. A locking device for a closing lid of a washing machine having a front panel and a sealing lid hinged to said front panel and provided with a hook for engagement with said locking device, said locking device comprising a containing body mounted to said panel and housing a cursor, equipped with an opening for receiving said hook and a delaying device adapted to lock said cursor in a position retaining said hook, a lever arranged in correspondence of said opening and connected to said body by connecting means allowing it to rotate and to axially translate, and provided with means for preventing the translation of said cursor.

2. The locking device for the closing lid of a washing machine according to claim 1, wherein said connecting means comprise helical springs.

3. The locking device for the closing lid of a washing machine according to claim 1, wherein said connecting means includes elastic flaps acting against ends of said lever.

4. The locking device for the closing lid of a washing machine according to claim 1, wherein said connecting means includes elastic flaps arranged on said lever that oppose pins fastened to said lid.

5. The locking device for the closing lid of a washing machine and according to claim 1, wherein said lever has a U-shaped profile.

6. The locking device for the closing lid of a washing machine according to claim 1, wherein said means preventing the translation of the cursor includes one or more small projections that fit into corresponding recesses in said cursor.

7. The locking device for the closing lid of a washing machine according to claim 1, wherein said lever is mounted on the lid of said containing body.

* * * * *